US011637396B2

(12) United States Patent
Lee et al.

(10) Patent No.: US 11,637,396 B2
(45) Date of Patent: Apr. 25, 2023

(54) ELECTRICAL CONNECTOR ASSEMBLY WITH A RELEASABLE LOCKING STRUCTURE

(71) Applicants: HYUNDAI MOTOR COMPANY, Seoul (KR); KIA CORPORATION, Seoul (KR); YURA CO., LTD, Hwaseong-si (KR); YURA CORPORATION CO., LTD., Seongnam-si (KR)

(72) Inventors: Sam Gyun Lee, Seoul (KR); Jeong Hyeon Sim, Hwaseong-si (KR); Young Ho Jo, Seongnam-si (KR); Hae Sung Park, Suwon-si (KR)

(73) Assignees: HYUNDAI MOTOR COMPANY, Seoul (KR); KIA CORPORATION, Seoul (KR); YURA CO., LTD, Hwaseong-si (KR); YURA CORPORATION CO., LTD., Seongnam-si (KR)

( * ) Notice: Subject to any disclaimer, the term of this patent is extended or adjusted under 35 U.S.C. 154(b) by 0 days.

(21) Appl. No.: 17/376,803

(22) Filed: Jul. 15, 2021

(65) Prior Publication Data

US 2022/0149558 A1 May 12, 2022

(30) Foreign Application Priority Data

Nov. 11, 2020 (KR) ..... 10-2020-0150169

(51) Int. Cl.
*H01R 13/506* (2006.01)
*H01R 13/627* (2006.01)

(52) U.S. Cl.
CPC ..... *H01R 13/506* (2013.01); *H01R 13/6273* (2013.01); *H01R 2201/26* (2013.01)

(58) Field of Classification Search
None
See application file for complete search history.

(56) References Cited

U.S. PATENT DOCUMENTS

| | | | | |
|---|---|---|---|---|
| 10,897,103 | B1 * | 1/2021 | Sundarakrishnamachari | H01R 13/5202 |
| 2009/0311896 | A1 * | 12/2009 | Myer | H01R 13/4223 439/248 |
| 2016/0056574 | A1 * | 2/2016 | Shimizu | H01R 13/627 439/160 |
| 2016/0079699 | A1 * | 3/2016 | Kobayashi | H01R 13/502 439/660 |

* cited by examiner

*Primary Examiner* — Oscar C Jimenez
(74) *Attorney, Agent, or Firm* — Lempia Summerfield Katz LLC

(57) ABSTRACT

An electrical connector assembly has a moving plate for protecting a terminal, which may easily separate the moving plate from a male plate for a rework operation for realigning a terminal pin without damage and may decrease a force when a female connector is inserted into and fastened to the male connector to push the moving plate. This improves the quality by reducing the difficulty when the female connector is inserted into and fastened to the male connector and improves a locking projection structure of the female connector such that the moving plate may easily return to the original location at all times when the female connector is separated.

7 Claims, 8 Drawing Sheets

ELECTRICAL CONNECTOR ASSEMBLY WITH A RELEASABLE LOCKING STRUCTURE

CROSS-REFERENCE TO RELATED APPLICATION

This application claims under 35 U.S.C. § 119(a) the benefit of priority to Korean Patent Application No. 10-2020-0150169 filed on Nov. 11, 2020, the entire contents of which are incorporated herein by reference.

BACKGROUND

(a) Technical Field

The present disclosure relates to an electrical connector assembly, and more specifically, to an electrical connector assembly having a moving plate for protecting a terminal mounted inside a male connector to hold and protect a plurality of terminal pins.

(b) Background Art

Generally, as an electric or electronic component for a vehicle, an electrical connector assembly for supplying a power source and exchanging an electrical signal is used.

The electrical connector assembly may be configured to include a male connector, a female connector, and a moving plate for protecting a terminal.

Referring to FIG. 1A, when a plurality of terminal pins 400 are fastened to the male connector 100, the respective terminal pins 400 are arranged in the linear state.

At this time, when an external force is applied to the terminal pin 400, the terminal pin 400 may be deformed such as bending.

Therefore, to prevent the deformation of the terminal pin 400, as illustrated in FIG. 1B, a moving plate 200 for holding and linearly aligning the terminal pins 400 is movably mounted inside the male connector 100.

Before the female connector is fastened to the male connector 100, as illustrated in FIG. 1B, the moving plate 200 is located at a location for holding the front end of each terminal pin 400. When the female connector is fastened to the male connector 100, the moving plate 200 is pushed by the female connector to move into the male connector 100.

At the same time, when the moving plate 200 moves into the male connector 100, the terminal pins 400 are arranged to protrude to the outside of the moving plate 200. Thus, the respective terminal pins 400 may be easily inserted into and fastened to the female connector.

The conventional electrical connector assembly has the following problems.

First, when the moving plate is separated from the male connector for a rework operation for realigning the terminal pin, there is a problem in that the male connector and the moving plate are damaged as the moving plate is forcibly separated using a predetermined tool. Further, there is a problem in that the damaged moving plate may not be recycled.

Second, the force when the female connector is inserted into and fastened to the male connector in order to push the moving plate is excessive. Thus, there is a problem of significantly lowering the quality in which the female connector is inserted into and fastened to the male connector. In other words, it may be unnecessarily difficult to insert the female connector and fasten it to the male connector.

Third, a locking projection structure pushing the moving plate to the original location is applied to the female connector such that the moving plate returns to the original location (location for holding the front end of each terminal pin) when the female connector is separated from the male connector. However, when a preceding operation laterally moving the female connector for separating the female connector is performed, the locking projection structure of the female connector does not push the moving plate. As a result, there is a problem in that the moving plate does not return to the original location, thereby losing the function of the moving plate.

The above information disclosed in this Background section is only to enhance understanding of the background of the disclosure. Accordingly, the Background section may contain information that does not form the prior art that is already known in this country to a person of ordinary skill in the art.

SUMMARY OF THE DISCLOSURE

The present disclosure is devised to solve the above problems of the related art. An object of the present disclosure is to provide an electrical connector assembly, which may easily separate the moving plate from the male connector without damage for the rework operation for realigning the terminal pin and decrease the force when the female connector is inserted into and fastened to the male connector in order to push the moving plate. This improves the quality in which the female connector is inserted into and fastened to the male connector, i.e., makes insertion less difficult. This also improves the locking projection structure of the female connector, thereby easily returning the moving plate to the original location at all times when the female connector is separated.

To achieve the object, the present disclosure provides an electrical connector assembly including a male connector, a moving plate movably mounted within the male connector for holding a terminal pin, and a female connector inserted into and fastened to the male connector. A slide groove having a fastening projection is formed on the inner surface of a side plate of the male connector. The outer surfaces of both sides of the moving plate are formed with elastic hooks moving along the slide groove while being locked to the fastening projection. A locking end is formed on a rear plate of the moving plate such that the moving plate is fixed to a location for holding the terminal pin. An elasticity fixing lever constraining the locking end is formed on the inner surfaces of an upper plate and a lower plate of the male connector. The front edge location of the female connector is formed with a constraint release protrusion for pushing the elasticity fixing lever constraining the locking end in the constraint release direction.

Locations of both sides of the rear plate of the male connector are formed with tool insertion holes for introducing jig tools for unlocking toward the elastic hooks locked to the fastening projections.

The locking end is formed on all sides of the rear plate of the moving plate. The elasticity fixing levers are formed on locations of both sides of the upper plate and the lower plate of the male connector.

In an embodiment, a support end for constraining the locking end is integrally further formed just next to or adjacent the elasticity fixing lever.

Further, the upper plate and the lower plate of the moving plate are formed with openings such that the elasticity fixing lever enters into the locking end to be constrainable.

To decrease a force by which the constraint release protrusion of the female connector pushes the elasticity fixing lever in the constraint release direction, the rear end of the elasticity fixing lever is integrally connected to the rear ends of the upper plate and the lower plate of the male connector to maximize the length of the elasticity fixing lever.

Both side plates of the moving plate are formed with elasticity return levers. Locking projections for pushing up the elasticity return lever are formed to protrude from both side surfaces of the female connector.

In an embodiment, the locking projection is formed to be inclined toward the front side of the female connector at 45° to 60° with respect to both side surfaces of the female connector in order to guarantee the operation of pushing up the elasticity return lever while minimizing a gap with the lower end of the elasticity return lever.

Through the above configuration, the present disclosure provides the following effects.

First, the present disclosure provides an advantage in that, upon the rework operation for realigning the terminal pin after the terminal pin of the male connector is mis-inserted into the moving plate or the like, the moving plate may be easily separated from the male connector without damage. Thus, this facilitates the rework operation and recycling of the moving plate.

Second, it is possible to decrease the force when the female connector is inserted into and fastened to the male connector in order to push the moving plate. Thus, this improves the quality in which the female connector is inserted into and fastened to the male connector, i.e., reduces the difficulty of inserting the female connector and fastening it to the male connector.

Third, it is possible to improve the locking projection structure of the female connector for pushing the moving plate to the original location to return the moving plate to the original location at all times when the female connector is separated from the male connector. Thus, this prevents the unique function of the moving plate holding the terminal pin from being lost.

It should be understood that the terms "automotive", "automobile", or "vehicular" or other similar terms as used herein include motor vehicles in general, such as: passenger automobiles including sports utility vehicles (SUVs), buses, and trucks; various commercial vehicles; watercraft including a variety of boats and ships; aircraft; and the like. Such terms also include hybrid vehicles, electric vehicles, plug-in hybrid electric vehicles, hydrogen-powered vehicles, and other alternative fuel vehicles (e.g., fuels derived from resources other than petroleum). As referred to herein, a hybrid vehicle is an automobile that has two or more sources of power, such as for example a vehicle that is both gasoline-powered and electric-powered.

The above and other features of the disclosure are discussed below.

BRIEF DESCRIPTION OF THE DRAWINGS

The above and other features of the present disclosure are now described in detail with reference to certain examples thereof illustrated in the accompanying drawings, which are given herein below by way of illustration only, and thus do not limit the present disclosure, and wherein.

Figure 1A:
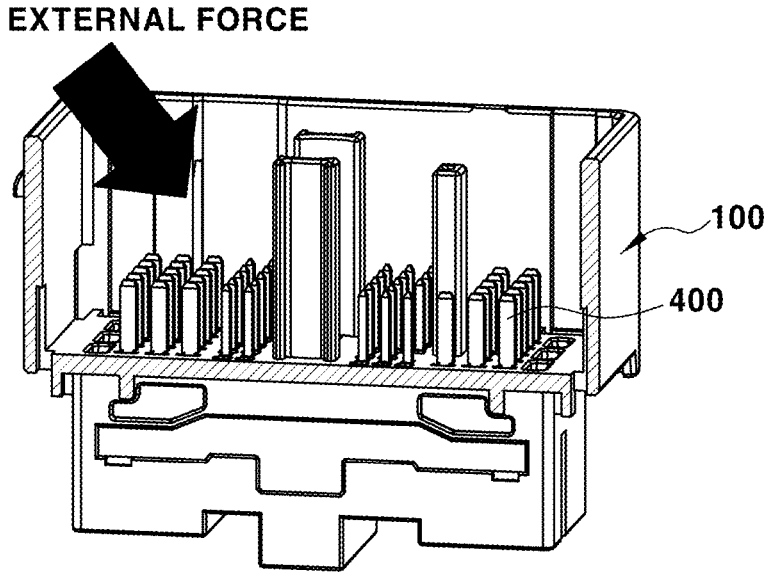
FIG. 1A Prior Art
FIG. 1A is a schematic diagram illustrating the state where a plurality of terminal pins is aligned within a male connector among components of an electrical connector assembly.
Figure 1B:
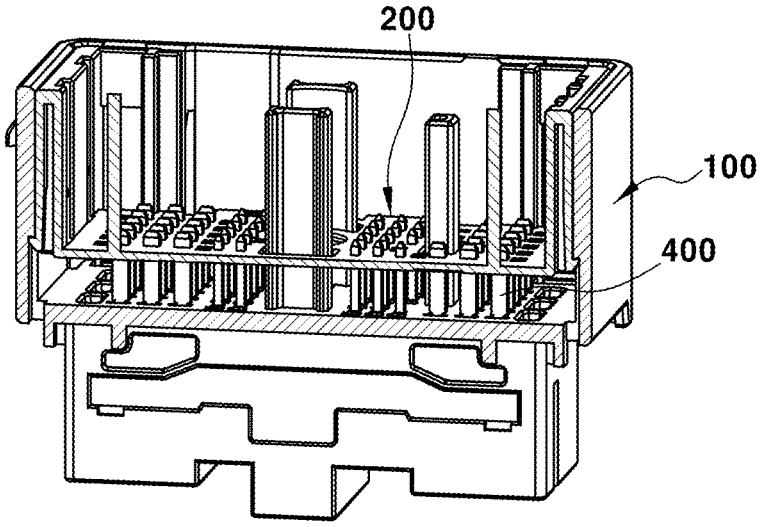
FIG. 1B Prior Art
FIG. 1B is a schematic diagram illustrating the state where a moving plate among the components of the electrical connector assembly is mounted by holding the plurality of terminal pins within the male connector.

It should be understood that the appended drawings are not necessarily to scale, presenting a somewhat simplified representation of various features illustrative of the basic principles of the disclosure. The specific design features of the present disclosure as disclosed herein, including, for example, specific dimensions, orientations, locations, and shapes should be determined by the particular intended application and use environment.

In the figures, reference numbers refer to the same or equivalent sections of the present disclosure throughout the several figures of the drawing.

DETAILED DESCRIPTION

Hereinafter, an embodiment of the present disclosure is described in detail with reference to the accompanying drawings. When a component, device, element, or the like of the present disclosure is described as having a purpose or performing an operation, function, or the like, the component, device, or element should be considered herein as being "configured to" meet that purpose or to perform that operation or function.

Figure 2:
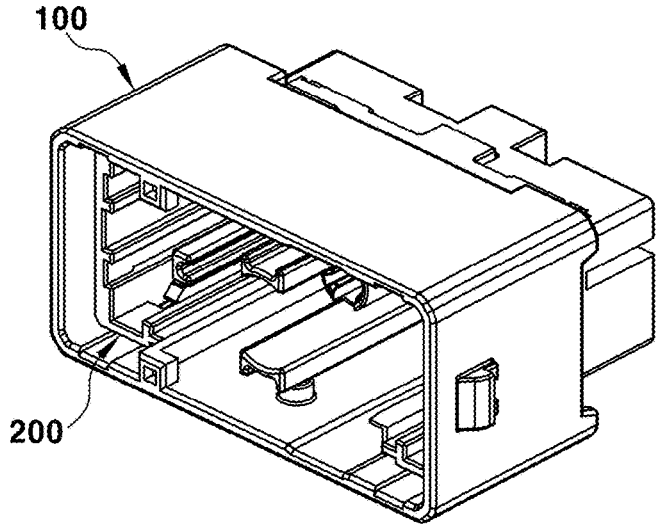
FIG. 2 is a diagram illustrating the appearance of the male connector of the electrical connector assembly according to the present disclosure.
Figure 3:
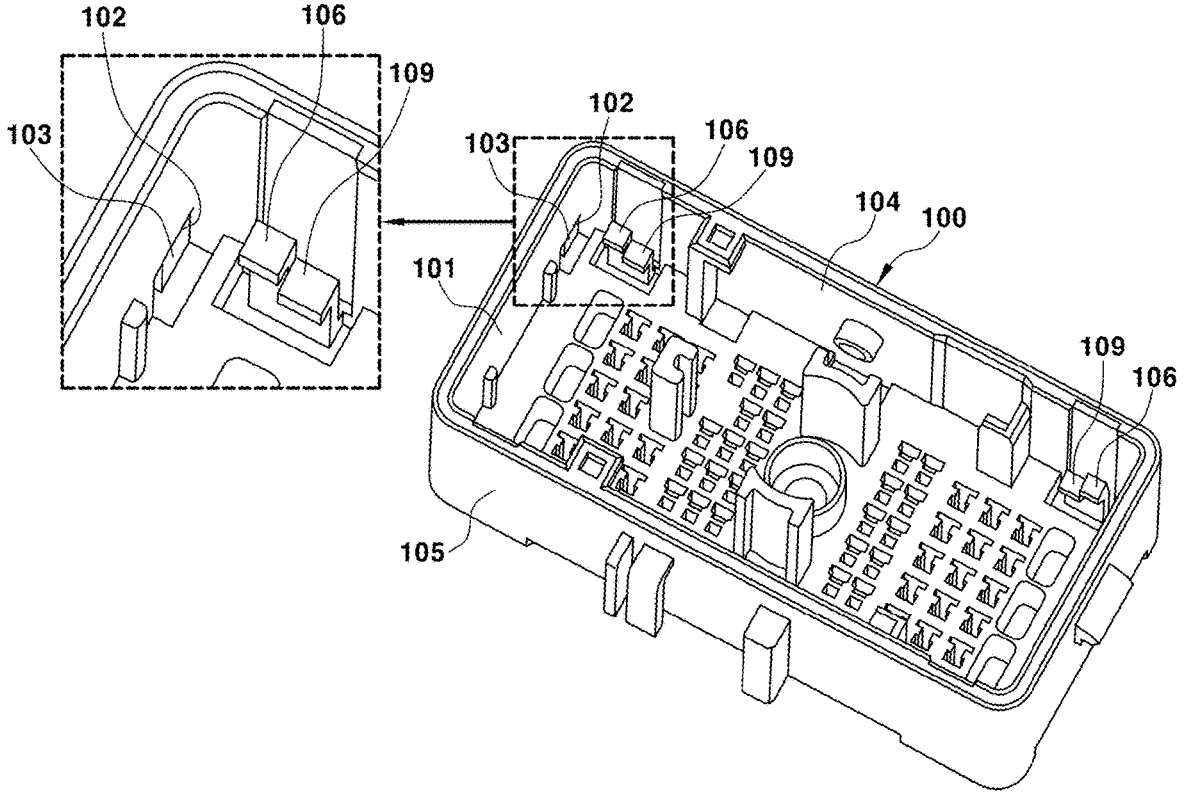
FIG. 3 is a diagram illustrating an inner structure of the male connector of the electrical connector assembly according to the present disclosure.
Figure 4:
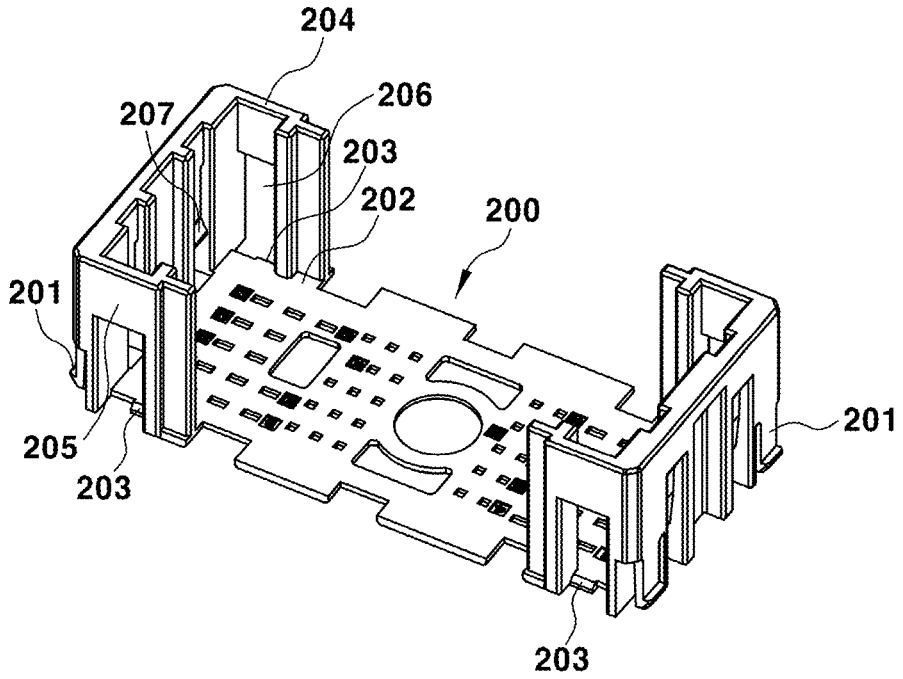
FIG. 4 is a diagram illustrating the moving plate of the electrical connector assembly according to the present disclosure.

FIG. 2 is a diagram illustrating the appearance of the male connector of the electrical connector assembly according to the present disclosure. FIG. 3 is a diagram illustrating an inner structure of the male connector of the electrical connector assembly according to the present disclosure. FIG. 4 is a diagram illustrating the moving plate of the electrical connector assembly according to the present disclosure.

As illustrated in FIG. 2, a moving plate 200 is embedded inside a male connector 100 to be movable inward or outward by a predetermined distance.

A male connector housing having the form illustrated in FIG. 3 is separately embedded inside the male connector 100 for the fastening between the moving plate 200 and terminal pins. The male connector housing is collectively referred to as the male connector to help understand the present disclosure.

Referring to FIG. 3, the inner surface of a side plate 101 adjacent to each edge location of the male connector 100 is formed with a slide groove 103 having a fastening projection 102.

Referring to FIG. 4, the outer surfaces of both sides of the moving plate 200 are formed with elastic hooks 201 moving along the slide groove 103 while being locked to the fastening projection 102.

Figure 8A:
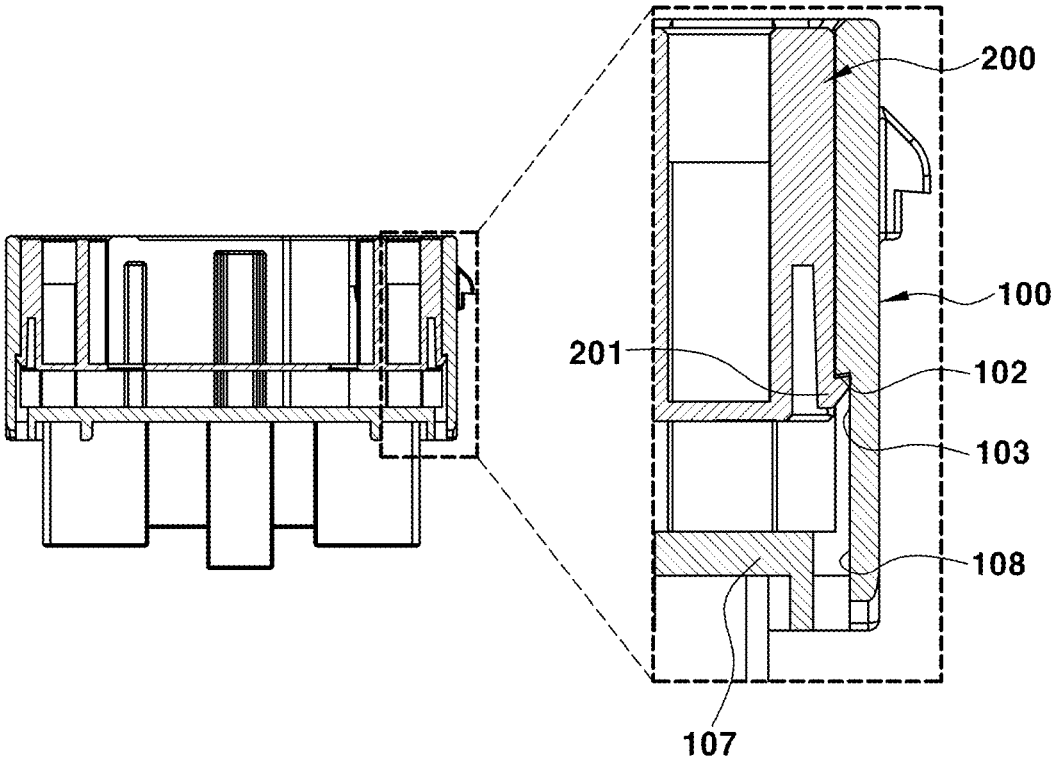
FIG. 8A is a cross-sectional diagram illustrating the state where the moving plate is inserted into and fastened to the male connector of the electrical connector assembly according to the present disclosure.

Therefore, when the moving plate 200 is inserted into and fastened to the male connector 100, as also illustrated in FIG. 8A, the elastic hook 201 is locked to the fastening projection 102 and movably located to the slide groove 103. Thus, the moving plate 200 becomes in the state of being not separated from the male connector 100.

The moving plate 200 inserted into and fastened to the male connector 100 should be fixed to a location for holding the terminal pin 400 before the female connector 300 is fastened.

To this end, as illustrated in FIG. 4, a rear plate 202 of the moving plate 200 is formed with a locking end 203. As illustrated in FIG. 3, an elasticity fixing lever 106 for constraining the locking end 203 is integrally formed on the inner surfaces of an upper plate 104 and a lower plate 105 of the male connector 100.

A support end 109 integrated just next to or adjacent the elasticity fixing lever 106 serves to substantially constrain the locking end 203.

In an embodiment, the locking end 203 is formed on locations of all sides of the rear plate 202 of the moving plate 200. The elasticity fixing lever 106 is formed on locations of both sides of the upper plate 104 and the lower plate 105 of the male connector 100.

In an embodiment, as illustrated in FIG. 4, an upper plate 204 and a lower plate 205 of the moving plate 200 are formed with openings 206 such that the elasticity fixing lever 106 of the male connector 100 enters into the locking end 203 of the moving plate 200 to be constrainable.

Figure 6A:
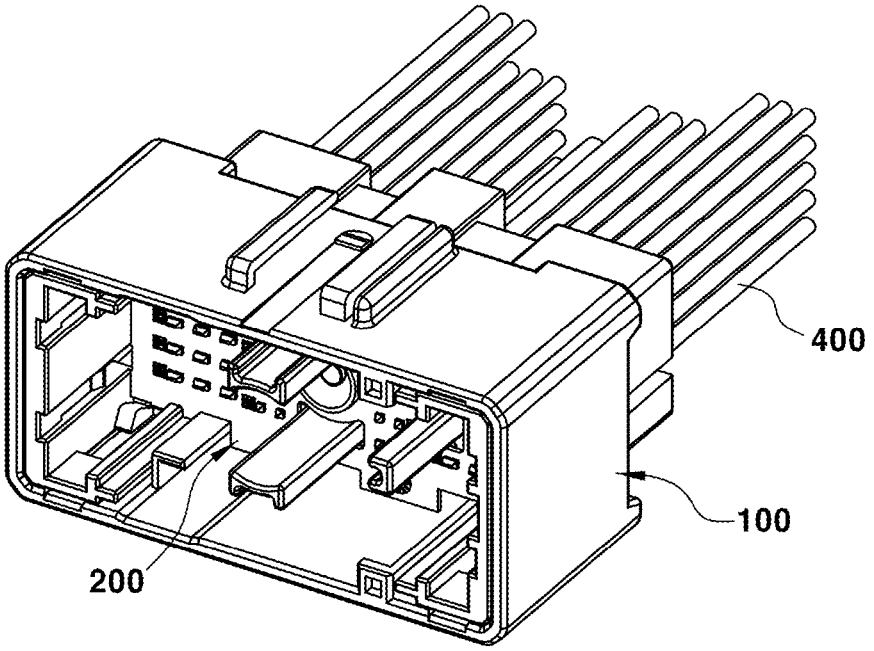
FIG. 6A is a diagram illustrating the state where a terminal pin is fastened to the male connector of the electrical connector assembly according to the present disclosure.
Figure 6B:
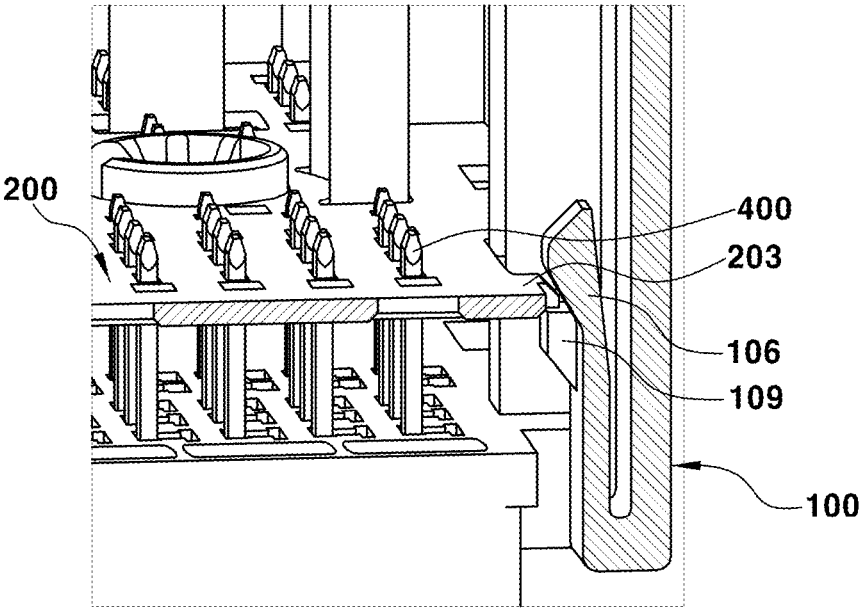
FIG. 6B is a diagram illustrating the state where the moving plate is mounted within the male connector of the electrical connector assembly according to the present disclosure, and the state where the terminal pin is inserted into and held in the moving plate.

Therefore, when the moving plate 200 is inserted into and fastened to the male connector 100, as also illustrated in FIG. 6B, the locking end 203 is in close contact with and constrained to the elasticity fixing lever 106. Thus, the moving plate 200 may be easily fixed to the location for holding the front ends of the terminal pins 400.

As illustrated in FIG. 6B, the support end 109 integrated just next to or adjacent the elasticity fixing lever 106 substantially supports and constrains the locking end 203. Thus, the moving plate 200 may be easily fixed to the location for holding the front ends of the terminal pins 400.

Here, a process of assembling the electrical connector assembly according to the present disclosure is described in order as follows.

First, an operation of fastening the terminal pin 400 to the male connector 100 and the female connector 300 precedes.

As illustrated in FIG. 6A, when a plurality of terminal pins 400 are fastened to the male connector 100, the terminal pins 400 entering into the male connector 100 become in the state of being inserted into the moving plate 200 and aligned linearly.

At this time, as illustrated in FIG. 6B, the moving plate 200 becomes in the state of holding the front ends of the terminal pins 400, thereby easily preventing the deformation of the terminal pins 400 by an external force.

Figure 6C:
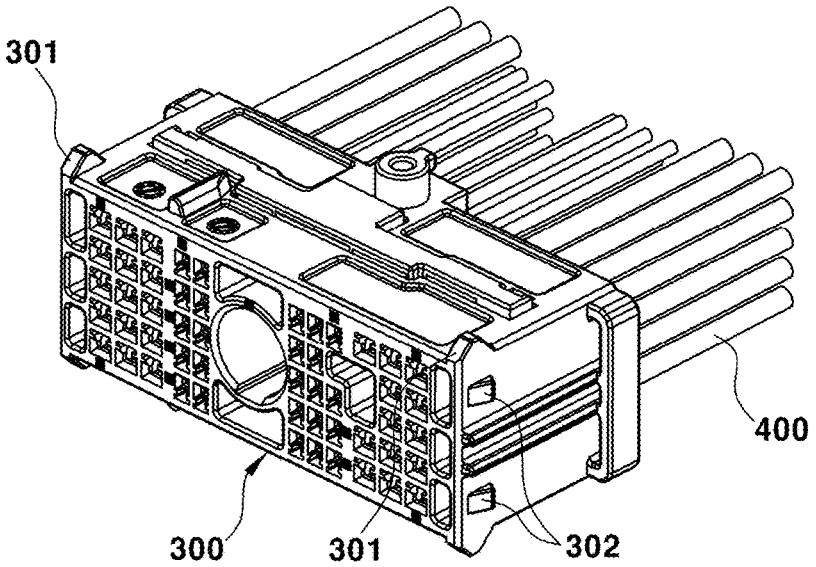
FIG. 6C is a diagram illustrating the state where the terminal pin is fastened to the female connector of the electrical connector assembly according to the present disclosure.

As illustrated in FIG. 6C, the female connector 300 fastened to the male connector 100 is also fastened to the terminal pins 400.

Figure 7:
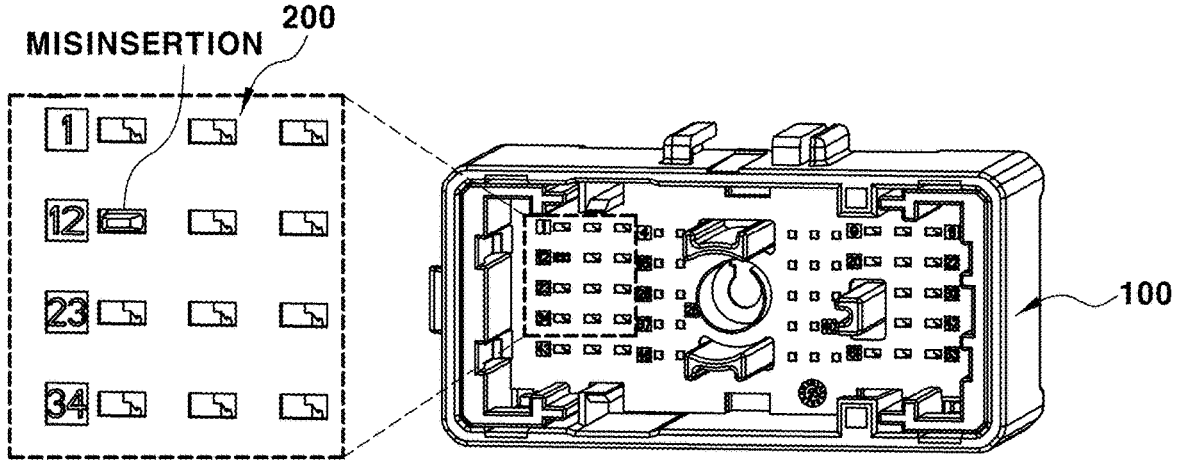
FIG. 7 is a schematic diagram illustrating an example in which the terminal pin is mis-inserted into the moving plate mounted within the male connector of the electrical connector assembly according to the present disclosure.

Meanwhile, after the terminal pins 400 are inserted into and fastened to the male connector 100, as illustrated in FIG. 7, one or more of the terminal pins 400 may be mis-inserted into the moving plate 200. To solve such a problem, a rework operation should be performed for detaching the moving plate 200 from the male connector 100 using a jig tool for unlocking to correctly realign the terminal pins 400.

Figure 8B:
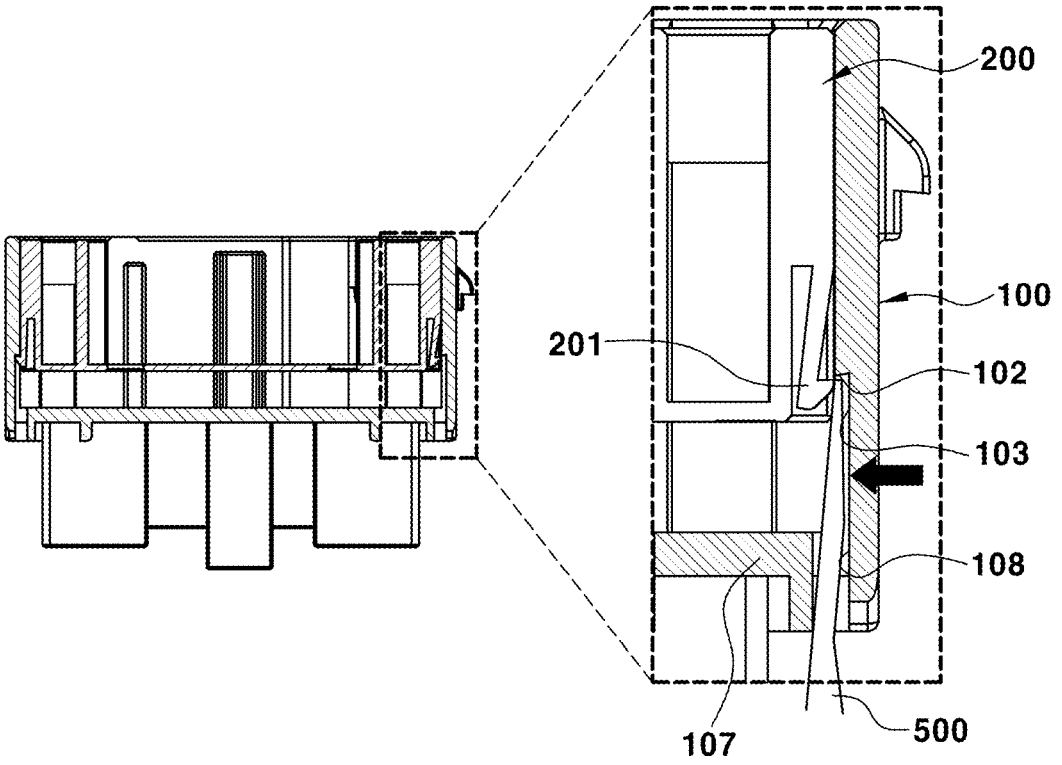
FIG. 8B is a cross-sectional diagram illustrating a structure of separating the moving plate from the male connector of the electrical connector assembly according to the present disclosure.

To this end, as illustrated in FIG. 8B, the locations of both sides of the rear plate 107 of the male connector 100 are formed with tool entering holes 108 for introducing jig tools 500 for unlocking toward the elastic hooks 201 of the moving plate 200 locked to the fastening projections 102.

Therefore, as illustrated in FIG. 8B, by inserting the jig tool 500 for unlocking through the tool entering hole 108 and bending back the elastic hook 201 in the unlocking direction, the moving plate 200 may be unlocked. Then the moving plate 200 may be easily separated from the male connector 100.

As described above, upon the rework operation for realigning the terminal pins 400 after the terminal pins 400 of the male connector 100 are mis-inserted into the moving plate 200 or the like, it is possible to easily separate the moving plate 200 from the male connector 100 without damage. This facilitates the rework operation such as realigning the terminal pins and facilitates recycling of the moving plate 200 again without damage.

Next, the female connector 300 may be fastened to the male connector 100 in the state where the terminal pins 400 of the male connector 100 are correctly aligned and the moving plate 200 holds the front ends of the terminal pins 400.

Figure 5:
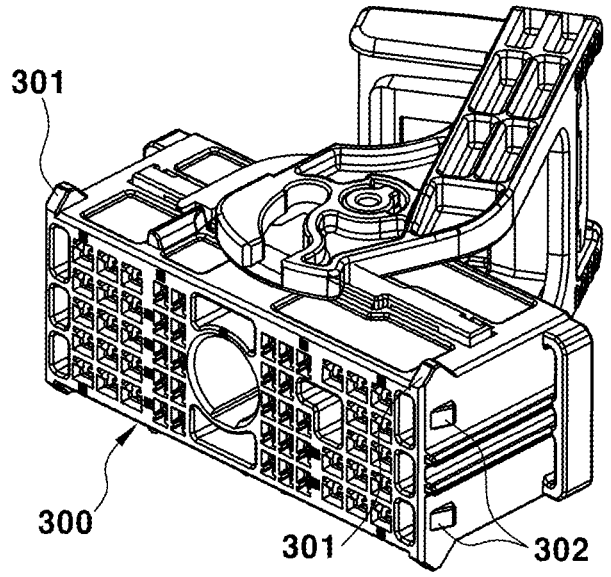
FIG. 5 is a diagram illustrating the appearance of a female connector of the electrical connector assembly according to the present disclosure.

As illustrated in FIG. 5, a constraint release protrusion 301 is formed to protrude from the front edge location of the female connector. The constraint release protrusion 301 is for pushing the elasticity fixing lever 106 of the male connector 100 constraining the locking end 203 of the moving plate 200 in the constraint releasing direction.

Figure 9A:
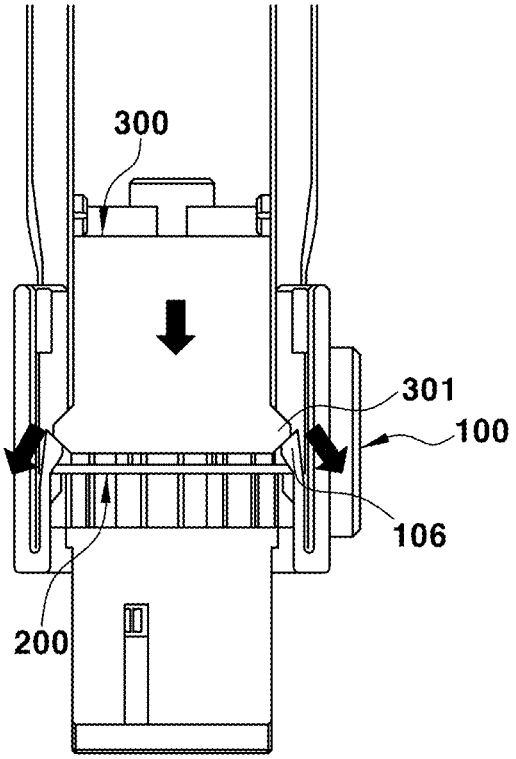
FIG. 9A is a cross-sectional diagram illustrating the operation of inserting and fastening the female connector into and to the male connector of the electrical connector assembly according to the present disclosure.

Therefore, as illustrated in FIG. 9A, when the female connector 300 is inserted into and fastened to the male connector 100, the constraint release protrusion 301 passes by while pushing the elasticity fixing lever 106 of the male connector 100 in the constraint release direction.

When the elasticity fixing lever 106 is pushed in the constraint release direction, the support end 109 is pushed together. Thus, the moving plate 200 becomes in the state of being movable to the inside of the male connector 100.

Subsequently, when the female connector 300 continues to be inserted into and fastened to the male connector 100 deeper, the moving plate 200 maximally moves to the inside of the male connector 100 by an insertion and pressing force of the female connector 300.

As described above, when the moving plate 200 maximally moves to the inside of the male connector 100, the terminal pins 400 of the male connector 100 are arranged to protrude to the outside of the moving plate 200. Thus, the respective terminal pins 400 may be easily inserted into and fastened to the female connector 300 to be conductible.

The length of the elasticity fixing lever 106 may be maximized in order to decrease the force by which the constraint release protrusion 301 of the female connector 300 pushes the elasticity fixing lever 106 in the constraint release direction to an appropriate level.

Figure 9B:
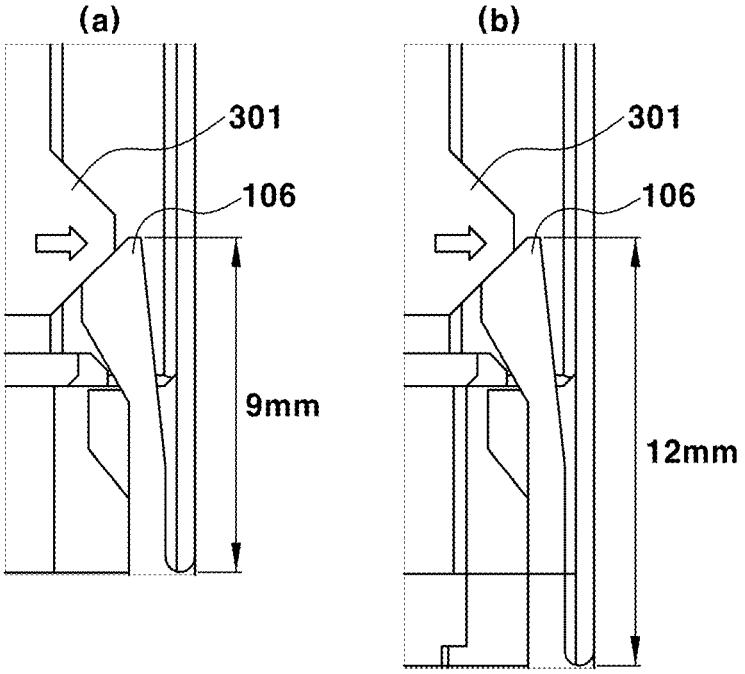
FIG. 9B is a comparison cross-sectional diagram illustrating that an insertion force when the female connector is inserted into the male connector of the electrical connector assembly according to the present disclosure is changed according to the length of an elasticity fixing lever of the male connector.

For example, as illustrated in the left side image (a) of FIG. 9B, as the length (e.g., 9 mm) of the elasticity fixing lever 106 is smaller, a holding force for displacement is stronger. Thus, significant force is applied by which the constraint release protrusion 301 of the female connector 300 pushes the elasticity fixing lever 106, thereby significantly lower the quality, i.e., increase the difficulty when the female connector is inserted into and fastened to the male connector.

On the other hand, as illustrated in the right side image (b) of FIG. 9B, as the length (e.g., 12 mm) of the elasticity fixing lever 106 is larger, a holding force for displacement is weaker. Thus, less force is applied by which the constraint release protrusion 301 of the female connector 300 pushes the elasticity fixing lever 106, thereby improving the quality, i.e., reducing the difficulty when the female connector is inserted into and fastened to the male connector.

To this end, as illustrated in FIG. 9A, the rear end of the elasticity fixing lever 106 is integrally connected to the rear ends of the upper plate 104 and the lower plate 105 of the male connector 100 to maximize the length of the elasticity fixing lever 106.

Therefore, when the female connector 300 is inserted into and fastened to the male connector 100 to push the moving plate 200, it is possible to decrease the force by which the constraint release protrusion 301 of the female connector 300 pushes the elasticity fixing lever 106 in the constraint release direction to the appropriate level.

Thus, this may improve the quality, i.e., reduce the difficulty when the female connector 300 is inserted into and fastened to the male connector 100.

Here, a process of separating the female connector of the electrical connector assembly according to the present disclosure from the male connector is described as follows.

When the female connector 300 is separated from the male connector 100, the moving plate 200 should return to the location for holding the front ends of the terminal pins 400, which are the original locations.

To this end, as illustrated in FIG. 4, both side plates of the moving plate 200 are formed with elasticity return levers 207 having a projection protruding inward. As illustrated in FIG. 5, locking projections 302 are formed to protrude from both side surfaces of the female connector 300 for pushing up the elasticity return lever 207 when the female connector 300 is separated.

At this time, when the female connector 300 is fastened to the male connector 100, the locking projection 302 of the female connector 300 is maintained in the state of having gone through the elasticity return lever 207 of the moving plate 200.

Figure 10:
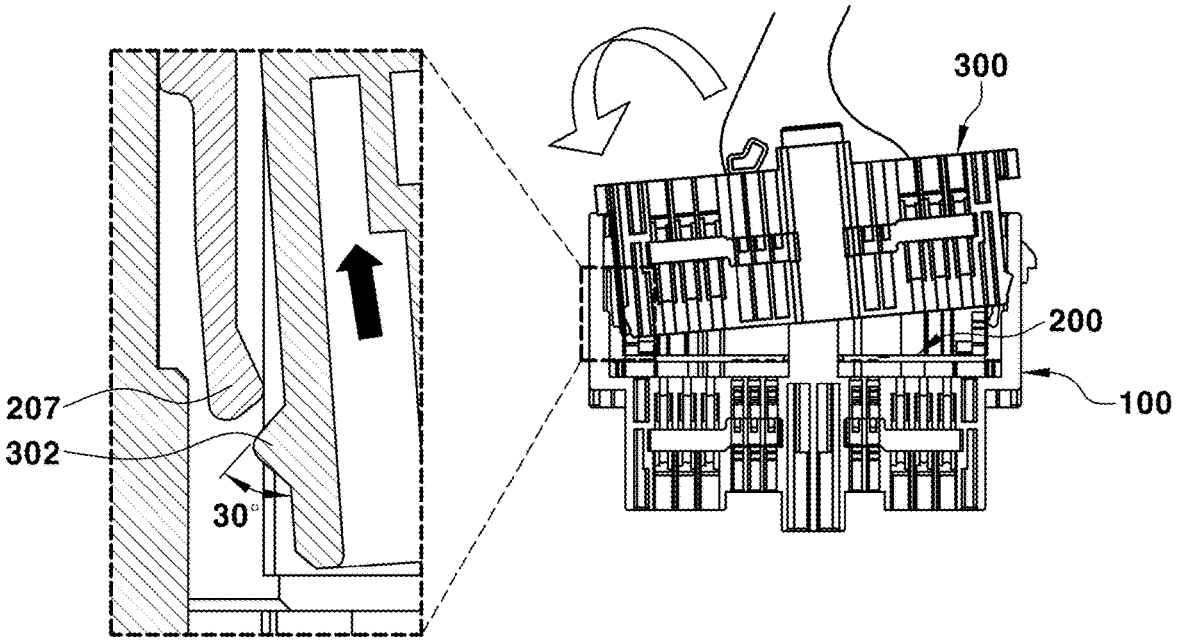
FIGS. 10 and 11 are cross-sectional diagrams illustrating the operation of separating the female connector from the male connector of the electrical connector assembly according to the present disclosure.

In such a state, an operator laterally moves the female connector 300 to separate the female connector 300 from the male connector 100, as illustrated in FIG. 10. Thus, the locking projection 302 of the female connector 300 moves away from the elasticity return lever 207 of the moving plate 200, thereby causing a gap therebetween.

Furthermore, if the locking projection 302 is formed to be inclined toward the front side of the female connector 300 at 30°, which is less than 45°, with respect to both side surfaces of the female connector 300, the gap between the locking projection 302 and the elasticity return lever 207 may be further increased.

Therefore, when the female connector 300 is separated from the male connector 100, the locking projection 302 does not properly push up the elasticity return lever 207. Thus, the moving plate 200 does not return to the location for holding the front ends of the terminal pins 400, which is the original location, thereby losing the unique function of the moving plate holding the terminal pin.

To solve such a problem, in other words, the operation in which the locking projection 302 pushes up the elasticity return lever 207 while minimizing the gap between the locking projection 302 and the elasticity return lever 207 should be guaranteed.

To this end, the locking projection 302 is formed to be inclined toward the front side of the female connector 300 at 45° to 60° with respect to both side surfaces of the female connector 300.

Figure 11:
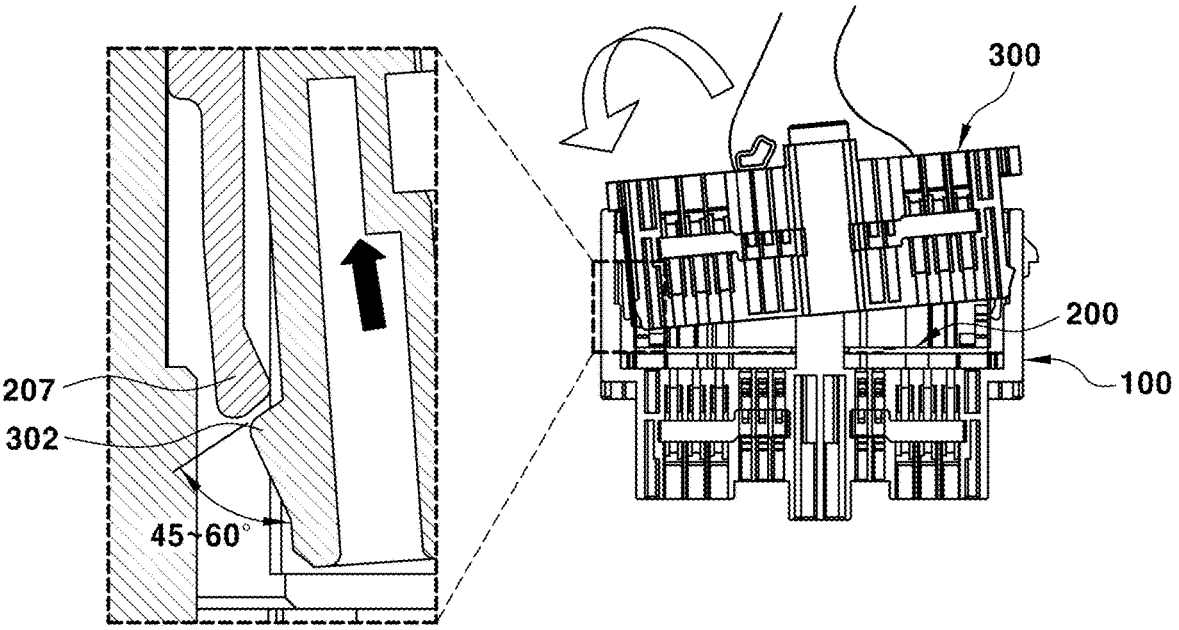

Therefore, as illustrated in FIG. 11, even if the operator laterally moves the female connector 300 to separate the female connector 300 from the male connector 100, it is possible to minimize the gap between the locking projection 302 and the elasticity return lever 207. Thus, an operation is guaranteed in which the locking projection 302 pushes up the elasticity return lever 207.

Therefore, when the female connector 300 is separated from the male connector 100, the moving plate 200 may move along the slide groove 103 to easily return to the original location. The unique function of the moving plate holding the front ends of the terminal pins 400 may thus be easily maintained.

What is claimed is:

1. An electrical connector assembly comprising a male connector, a moving plate movably mounted within the male connector for holding a plurality of terminal pins, and a female connector inserted into and fastened to the male connector, wherein a slide groove having a fastening projection is formed on an inner surface of a side plate of the male connector, and outer surfaces of both sides of the moving plate are formed with elastic hooks configured to move along the slide groove while being locked to the fastening projection, wherein a locking end is formed on a rear plate of the moving plate such that the moving plate is fixed to a location for holding the terminal pin, and elasticity fixing levers constraining the locking end are formed on inner surfaces of an upper plate and a lower plate of the male connector, wherein a front edge location of the female connector is formed with a constraint release protrusion configured to push the elasticity fixing levers constraining the locking end in the constraint release direction, wherein both side plates of the moving plate are formed with elasticity return levers, and wherein locking projections are formed to protrude from both side surfaces of the female connector and configured to push up the elasticity return levers.

2. The electrical connector assembly of claim 1, wherein, at locations of both sides of a rear plate of the male connector, tool insertion holes are formed for introducing jig tools for unlocking toward the elastic hooks locked to the fastening projections.

3. The electrical connector assembly of claim 1, wherein the locking end is formed on all sides of the rear plate of the moving plate, and the elasticity fixing levers are formed on locations of both sides of the upper plate and the lower plate of the male connector.

4. The electrical connector assembly of claim 3, wherein a support end for constraining the locking end is integrally further formed adjacent to the elasticity fixing levers.

5. The electrical connector assembly of claim 3, wherein an upper plate and a lower plate of the moving plate are formed with openings such that the elasticity fixing levers are configured to enter into the locking end to be constrainable.

6. The electrical connector assembly of claim 1, wherein, to decrease a force by which the constraint release protrusion of the female connector pushes the elasticity fixing levers in the constraint release direction, a rear end of the elasticity fixing levers is integrally connected to rear ends of the upper plate and the lower plate of the male connector to maximize a length of the elasticity fixing levers.

7. The electrical connector assembly of claim 1, wherein the locking projections are formed to be inclined toward a front side of the female connector at 45° to 60° with respect to both side surfaces of the female connector in order to guarantee that the elasticity return levers are pushed up while minimizing a gap with a lower end of the elasticity return levers.

* * * * *